US009447355B2

(12) United States Patent
Jacob

(10) Patent No.: US 9,447,355 B2
(45) Date of Patent: Sep. 20, 2016

(54) FUEL FOR COMPRESSION-IGNITION ENGINES BASED ON MONOOXYMETHYLENE DIMETHYLETHER

(71) Applicant: Eberhard Jacob, Krailling (DE)

(72) Inventor: Eberhard Jacob, Krailling (DE)

(73) Assignee: MAN TRUCK & BUS AG, Munich (DE)

( * ) Notice: Subject to any disclaimer, the term of this patent is extended or adjusted under 35 U.S.C. 154(b) by 0 days.

(21) Appl. No.: 14/165,793

(22) Filed: Jan. 28, 2014

(65) Prior Publication Data

US 2014/0223807 A1 Aug. 14, 2014

(30) Foreign Application Priority Data

Jan. 28, 2013 (DE) ..... 10 2013 001 490

(51) Int. Cl.

| | |
|---|---|
| ***C10L 1/12*** | (2006.01) |
| ***C10L 10/06*** | (2006.01) |
| ***C10L 1/02*** | (2006.01) |
| ***C10L 10/12*** | (2006.01) |
| *C10L 1/18* | (2006.01) |
| *C10L 1/185* | (2006.01) |
| *C10L 1/198* | (2006.01) |

(52) U.S. Cl.

CPC ..... *C10L 10/06* (2013.01); *C10L 1/02* (2013.01); *C10L 1/026* (2013.01); *C10L 1/185* (2013.01); *C10L 10/12* (2013.01); *C10G 2300/307* (2013.01); *C10L 1/1811* (2013.01); *C10L 1/1852* (2013.01); *C10L 1/1985* (2013.01); *C10L 2270/026* (2013.01); *C10L 2300/20* (2013.01)

(58) Field of Classification Search

CPC . C10G 2300/307; C10L 10/06; C10L 10/12; C10L 1/02; C10L 1/026; C10L 1/1811; C10L 1/185; C10L 1/1852; C10L 1/1985; C10L 2270/026; C10L 2300/20; H01M 2/166; H01M 2/1673; H01M 2/1686; Y02T 10/7011

USPC ..... 44/322, 448

See application file for complete search history.

(56) References Cited

U.S. PATENT DOCUMENTS

| | | | | |
|---|---|---|---|---|
| 2,796,423 | A * | 6/1957 | Cottle et al. | 554/223 |
| 3,385,816 | A * | 5/1968 | Sawyer et al. | 524/757 |
| 5,011,503 | A | 4/1991 | Buxton | |
| 5,314,511 | A | 5/1994 | Liotta, Jr. | |

(Continued)

FOREIGN PATENT DOCUMENTS

| | | |
|---|---|---|
| CN | 101434874 A | 5/2009 |
| CN | 101213274 B | 12/2011 |

(Continued)

OTHER PUBLICATIONS

Lump et al."Oxymethylene Ethers as Diesel Fuel Additives of the Future". MTZ Worldwide eMagazine. Mar. 2011. Volume 72, Issue 3. pp. 34-38.*

(Continued)

*Primary Examiner* — Latosha Hines

(74) *Attorney, Agent, or Firm* — Fay Sharpe LLP

(57) ABSTRACT

A fuel for compression-ignition engines is described, which contains mono oxymethylene dimethyl ether and has a cetane number of ≥51. This fuel for compression-ignition engines advantageously contains oxygenates of the n-poly-oxaalkane type and/or di-tert-butyl peroxide. Up to about 20% by weight of the mono oxymethylene dimethyl ether can be replaced by dimethyl ether.

15 Claims, 1 Drawing Sheet

(56) References Cited

U.S. PATENT DOCUMENTS

| | | | | |
|---|---|---|---|---|
| 7,241,031 | B2 | 7/2007 | Sloan et al. | |
| 2002/0020107 | A1* | 2/2002 | Bailey | C10L 1/026 44/447 |
| 2006/0156619 | A1* | 7/2006 | Crawshaw et al. | 44/385 |
| 2007/0260094 | A1* | 11/2007 | Schelling et al. | 568/600 |
| 2008/0216390 | A1* | 9/2008 | Tebben et al. | 44/307 |
| 2010/0005707 | A1 | 1/2010 | Jacob | |

FOREIGN PATENT DOCUMENTS

| | | | |
|---|---|---|---|
| CN | 102268304 | B | 9/2014 |
| DE | 19633725 | A1 * | 2/1997 |
| EP | 0903395 | A1 | 3/1999 |
| EP | 1070755 | A1 | 1/2001 |
| WO | 2006051424 | A1 | 5/2006 |
| WO | 2007000428 | A1 | 1/2007 |
| WO | WO 2007000428 | A1 * | 1/2007 |

OTHER PUBLICATIONS

English Translation of DE 19633725 A1.*

EP 14 15 2761 Search Report.

Abou-Rachid, H. et al.: On the correlation . . . In: J. Mol. Struct. (Theochem) 2003, vol. 293, S. 293-304.—ISSN 0166-1280.

Ren, Y. et al.: Combustion characteristics . . . In: Appl. Therm. Eng., 2006, vol. 26, S. 327-337.

Burger, J. et al.: Poly(oxymethylene) dimethyl ethers . . . In: Fuel, 2010, vol. 89, S. 3315-3319.

Vertin et al., Methylal and Methylal-Diesel Blended Fuels for Use in Compression-Ignition Engines, The Engineering Society for Advancing Mobility Land Sea Air and Space International, SAE Technical Paper Series, 1999-01-1508, International Spring Fuels & Lubricants Meeting & Exposition, Dearborn, Michigan, May 3-6, 1999, 15 pages, Warrendale, PA.

* cited by examiner

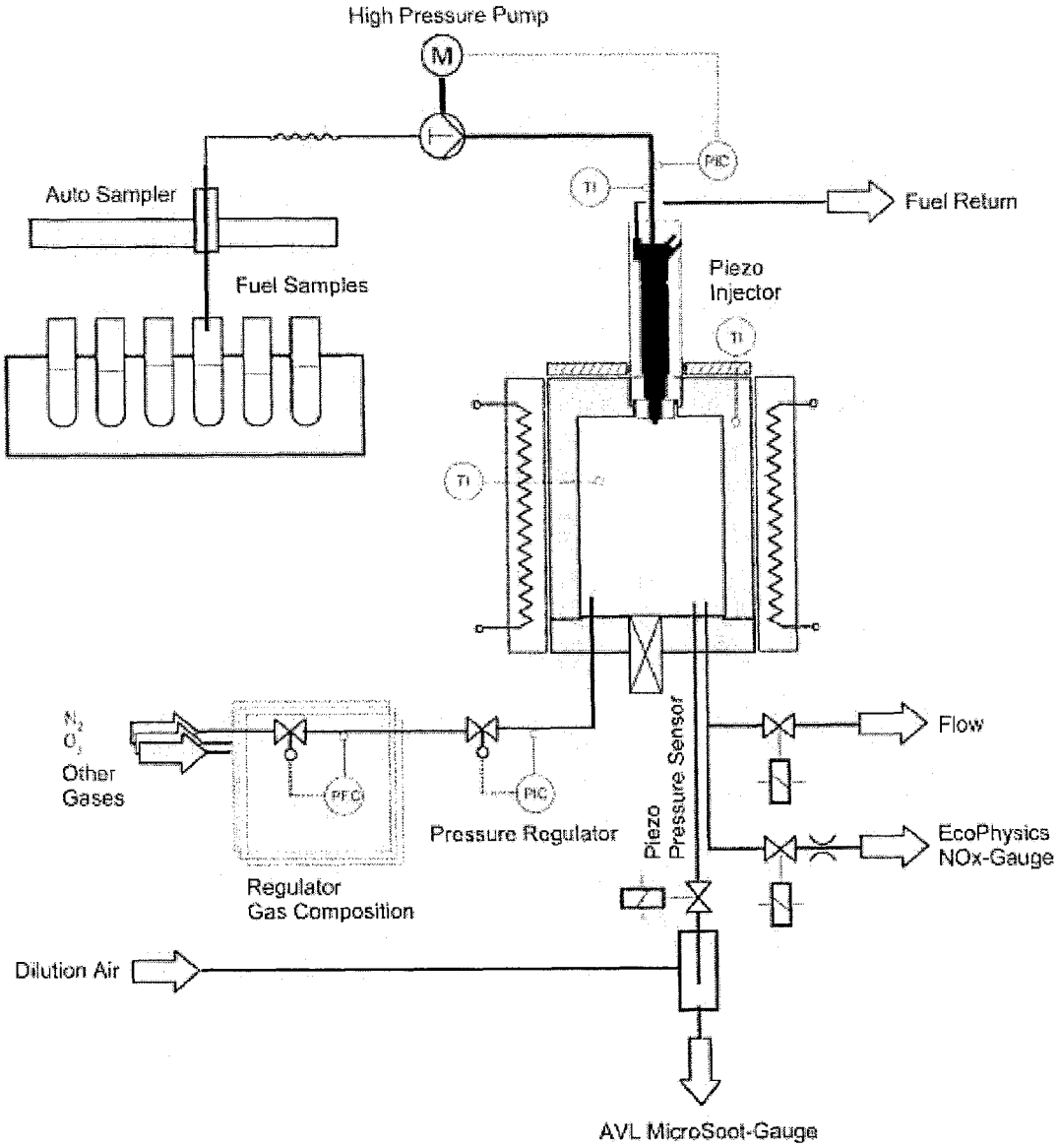
High Pressure Pump
M
PIC
TI
Fuel Return
Auto Sampler
Fuel Samples
Piezo
Injector
TI
TI
$N_2$
$O_2$
Other
Gases
PFC
PIC
Pressure Regulator
Piezo
Pressure Sensor
Flow
EcoPhysics
NOx-Gauge
Regulator
Gas Composition
Dilution Air
AVL MicroSoot-Gauge

FUEL FOR COMPRESSION-IGNITION ENGINES BASED ON MONOOXYMETHYLENE DIMETHYLETHER

BACKGROUND

The invention relates to a fuel for compression-ignition engines, i.e. a diesel fuel.

Mixtures of monooxymethylene dimethylether (dimethoxymethane) and diesel are known as fuels for diesel engines from SAE TECHNICAL PAPER SERIES, 1999-01-1508, pages 1 to 13. The addition of diesel fuel is used here to increase the cetane number of the mono oxymethylene dimethyl ether from 29 to values of above 40. The addition of diesel fuel, however, leads to an undesired soot emission. On the other hand, it is not possible to operate a diesel engine with pure monooxymethylene dimethylether as the latter has too low a cetane number of 29. This results in the fact that a cold start is impossible and misfiring occurs during a part load operation.

The use of dioxymethylene dimethylether and trioxymethylene dimethyl ether/tetraoxymethylene dimethylether mixtures as an addition to diesel fuel is known from the technical motor journal MTZ, 72$^{nd}$ volume, page 198 to 202 (2011). The use of these ethers leads to a significant reduction in the soot emission but a particle filter is still necessary to satisfy the existing legal requirements. In addition to this there is the fact that these polyoxymethylene dimethylether mixtures can only be produced at great expense.

BRIEF DESCRIPTION

The invention is based on the object of overcoming the above drawbacks. In particular, the invention is based on the object of satisfying the existing legal requirements for lowering the $CO_2$ emission and the emission of air impurities, using residual biomass and carbon dioxide as the starting material for producing a fuel for compression-ignition engines, achieving a combustion of the fuel that is as free of soot as possible in the engine in order to thus provide the basis for very low exhaust emissions (local zero emissions in accordance with the example of electric vehicles), providing a non-toxic replacement material for methanol, achieving a high exhaust gas recycling compatibility for $NO_x$ reduction inside the engine and reducing the costs, the volume and the weight of exhaust gas post-treatment systems, for example by avoiding particle filters.

According to the invention, this object is achieved with a fuel for compression-ignition engines, i.e. a diesel fuel, according to claim 1, which contains mono oxymethylene dimethylether (dimethoxymethane) and is characterised in that it has a cetane number (CN) of ≥48.6, preferably ≥51.

BRIEF DESCRIPTION OF THE DRAWINGS

FIG. 1 is a schematic diagram of a system in accordance with some embodiments of the present disclosure.

The term "contains" also comprises the term "consists of".

DETAILED DESCRIPTION

The fuel according to the invention for compression-ignition engines therefore comprises monooxymethylene dimethylether as the basic fuel. Mono oxymethylene dimethylether (dimethoxymethane) has the structural formula $CH_3OCH_2OCH_3$.

The use of monooxymethylene dimethylether firstly has the advantage that, in contrast to all the higher polyoxymethylene dimethylethers, such as for example, a trioxymethylene dimethylether/tetraoxymethylene dimethylether mixture, it is already produced on an industrial scale.

In a preferred embodiment, the fuel according to the invention for compression-ignition engines contains at least about 80% by weight, preferably at least about 90% by weight, and particularly preferably at least about 95% by weight mono oxymethylene dimethylether.

As mentioned, it is decisive to achieve the objects mentioned above that the fuel according to the invention for compression-ignition engines has a cetane number of ≥48.6, preferably ≥51.

In a preferred embodiment, the fuel according to the invention for compression-ignition engines does not contain any proportions of conventional diesel fuels based on hydrocarbon. This ensures a still more advantageous soot-free fuel combustion.

In a preferred embodiment a cetane number of ≥48.6, preferably ≥51, is achieved in the fuel according to the invention for compression-ignition engines in that the latter contains at least one oxygenate of the n-polyoxaalkane type, which is selected from the group consisting of polyoxymethylene dialkylether of the formula $RO(—CH_2O—)_nR$, wherein n=4 to 10 and R=an alkyl group, polyethylene glycol dialkylethers and/or polyethylene glycol monoalkyletherformals.

In a preferred embodiment, the fuel according to the invention for compression-ignition engines contains up to about 20% by weight, preferably up to about 5% by weight, particularly preferably up to about 3% by weight, of at least one aforementioned oxygenate of the n-polyoxaalkane type.

The cetane number increases virtually linearly with the concentration of the at least one oxygenate of the n-polyoxaalkane type. The increase in the cetane number also correlates with the molecular weight MG of the oxygenate used of the n-polyoxaalkane type. In other words, the higher the molecular weight, the less oxygenate of the n-polyoxaalkane type has to be used. Oxygenates of the n-polyoxaalkane type with a molecular weight MG>1000 daltons are, however, less suitable and they dissolve comparatively poorly in mono oxymethylene dimethylether, particularly in the cold.

The alkyl group of the at least one oxygenate of the n-polyoxaalkane type involves end-closing alkyl groups, for example methyl or ethyl groups. These are preferably methyl groups. It is therefore preferred that the polyoxymethylene dialkyl ether of the formula $RO(—CH_2O—)_nR$, wherein n=4 to 10 and R=an alkyl group, is polyoxymethylene dimethylether of the formula $CH_3O(—CH_2O—)_nCH_3$, wherein n=4 to 10. Particularly preferably, n=5 to 9 and quite particularly preferably 6 to 7.

The polyethylene glycol dialkyl ethers are preferably polyethylene glycol dimethyl ethers.

The polyethylene glycol monoalkyl etherformals are preferably polyethylene glycol monomethyl etherformals.

It is preferred that the polyoxymethylene dimethyl ethers have a molecular weight MG of 100 to 400 daltons, preferably from 166 to 346 daltons.

The polyoxymethylene dimethyl ethers are preferably used in a quantity of up to about 20% by weight, particularly preferably up to about 5% by weight and quite particularly preferably up to about 3% by weight.

A particularly preferred polyoxymethylene dimethyl ether is tetraoxymethylene dimethylether, as the latter leads to a clear viscosity increase.

In a particularly preferred embodiment, the polyethylene glycol dimethylethers have a molecular weight MG of 400 to 1000 daltons, preferably 500 to 1000 daltons.

The polyethylene glycol dimethylethers are preferably used in a quantity of up to about 20% by weight and particularly preferably up to about 5% by weight.

Suitable polyethylene glycol dimethylethers are, for example, polyglycol DME 500, polyglycol DME 750 and polyglycol DME 1000, all obtainable from the company Clariant. Polyethylene glycol DME 500 is preferably used in a quantity of up to about 20% by weight, particularly preferably up to about 10% by weight and quite particularly preferably up to about 5% by weight. Polyglycol DME 750 is preferably used in a quantity of up to about 10% by weight and particularly preferably up to about 5% by weight. Polyglycol DME 1000 is preferably used in a quantity of up to about 6% by weight and particularly preferably up to about 3% by weight.

Polyethylene glycol dialkylethers, in particular polyethylene glycol dimethyl ethers, are already produced on an industrial scale, which facilitates the introduction of the fuel according to the invention for compression-ignition engines.

The polyethylene glycol monomethyl etherformals preferably have a molecular weight from 400 to 1100 daltons.

Polyethylene glycol monomethyl etherformals are preferably used in a quantity of up to about 20% by weight, preferably up to about 10% by weight and quite particularly preferably up to about 5% by weight. Polyethylene glycol monomethylether formals with a molecular weight of below 400 daltons, for example 2,5,7,10-tetraoxaundecane with a molecular weight of 192 daltons, are less effective. Higher molecular polyethylene glycol monomethylether formals, i.e. polyethylene glycol monomethyletherformals with a molecular weight from 400 to 1100 daltons are particularly suitable. For example tetraethylene glycol monomethyletherformals with a MG of 428 daltons can be used. This is obtainable, for example, from two moles tetraethylene glycol monomethylether and one mole methanal. Polyethylene glycol monomethyl ether formed with a molecular weight MG of 950 to 1070 daltons can also be used, for example. This is obtainable, for example, from two moles polyethylene glycol monomethylether with a molecular weight MG of 470 to 530 daltons for example polyglycol M from Clariant and one mole methanal.

Polyethylene glycol monoalkyletherformals, in particular polyethylene glycol monomethyl etherformals, can be produced by known methods from the polyethylene glycol monoalkylethers produced on an industrial scale by conversion with methanal, for example as paraformaldehyde.

The use of polyethylene glycol monoalkyl etherformals, in particular polyethylene glycol monomethyl etherformals, leads to similar results to the use of polyoxymethylene dialkylethers, in particular polyoxymethylene dimethylether.

The use of at least one oxygenate of the n-polyoxaalkane type does not only lead to the fact that the cetane number of the fuel according to the invention for compression-ignition engines is raised to ≥48.6, preferably ≥51, but also to the fact that the physical properties of the fuel according to the invention for compression-ignition engines, for example the viscosity, the surface tension, the vapour pressure and the compressibility (modulus of elasticity) approximate those of a diesel fuel.

The kinematic viscosity of mono oxymethylene dimethylether is 0.40 $mm^2/s$ at 20° C. and therefore below the minimum requirements of the standard EN 590 (standard for diesel fuel DIN EN 590, May 2010 edition) of 2 $mm^2/s$ by a factor of 5. The difference can lead to problems when using standard diesel injection systems. Thus the leakage quantities at gap seals can increase. The use of at least one oxygenate of the n-polyoxaalkane type also provides a remedy here in that the viscosity of the fuel according to the invention for compression-ignition engines is increased. The injection characteristic can thus be positively influenced. For example, the mean drop diameter and the penetration depth of the fuel jet are increased by an increase in the viscosity.

The lubricity of monooxymethylene dimethylether, because of its polar properties, is already within the range of a diesel fuel. However, the use of at least one oxygenate of the n-polyoxaalkane type leads to a further improvement, i.e. to an increase in the lubricity (HFRR reduction).

Monooxymethylene dimethylether has a surface tension of 21.2 mN/m at 25° C. The use of at least one oxygenate of the n-polyoxaalkane type in the fuel according to the invention for compression-ignition engines increases this value to up to 26 mN/m (in comparison to this, diesel fuel has a surface tension of 27 to 28 mN/m). The surface tension has a decisive influence on the drop size distribution produced during the atomisation process and therefore also on the penetration depth of the fuel jet. When designing the fuel injection, the penetration depth of the jet can be influenced, for example, by the use of a suitable quantity of the at least one oxygenate of the n-polyoxaalkane type.

Monooxymethylene dimethylether has a vapour pressure of 45 kPa at 20° C. By using at least one oxygenate of the n-polyoxaalkane type, it is possible to lower the vapour pressure by up to 10%.

The energy balance chain for the production of monooxymethylene dimethyl ether (OME 1) compared to, for example, tetraoxymethylene dimethylether (OME 4) from methanol and methanal also provides significant advantages:

$$2CH_3OH+CH_2O \rightarrow C_3H_8O_2(OME1) \quad \text{(equation 1)}$$

$$2CH_3OH+4CH_2O \rightarrow C_6H_{14}O_5(OME4) \quad \text{(equation 2)}$$

The production of $CH_2O$ takes place by partial, exothermic oxidation of the methanol:

$$2CH_3OH+O_2 \rightarrow 2CH_2O+H_2O \quad \text{(equation 3) } \Delta H=-318 \text{ kJ/mol}$$

By combining equation 1 and 2 with equation 3 we obtain:

$$6CH_3OH+O_2 \rightarrow 2C_3H_8O_2(OME1)+2H_2O \quad \text{(equation 4)}$$

$$6CH_3OH+2O_2 \rightarrow C_6H_{14}O_5(OME4)+5H_2O \quad \text{(equation 5)}$$

It is seen that the oxygen consumption and therefore the energy loss during the production of OME4 from methanol according to equation 5 is twice as high as during the production of OME1 according to equation 4.

In a preferred embodiment, the fuel according to the invention for compression-ignition engines contains di-tert-butyl peroxide (DTBP). Di-tert-butyl peroxide also leads to the desired increase in the cetane number.

Di-tert-butyl peroxide is preferably added in a quantity of 0.01 to 0.3% by weight and particularly preferably in a quantity of 0.1 to 0.2% by weight. Too low a quantity does not lead to the desired cetane number increase, while too high a quantity is to be avoided for cost reasons.

The use of di-tert-butyl peroxide furthermore has the advantage that, in contrast to cetane number improvers based on nitrate, such as, for example, 2-ethylhexyl nitrate, it combusts without the formation of fuel $NO_x$.

Di-tert-butyl peroxide is very suitable as a cetane number improver for fuels for compression-ignition engines with monooxymethylene dimethylether as the basic fuel. Thus, the addition of 0.1% by weight di-tert-butyl peroxide in conjunction with monooxymethylene dimethylether as the basic fuel leads to an increase in the cetane number by 8 units, while in the case of diesel fuel, the average increase is only between 2 and 4 units (SAE 952368, 1995).

In a particularly preferred embodiment, the fuel according to the invention for compression-ignition engines contains monooxymethylene dimethylether, at least one oxygenate of the n-polyoxaalkane type and di-tert-butyl peroxide, the latter preferably in a quantity of 0.01 to 0.3% by weight. Owing to the addition of di-tert-butyl peroxide, it is possible, if desired, to reduce the quantity of the at least one oxygenate of the n-polyoxaalkane type with respect to the cetane number increase.

In a particularly preferred embodiment, the fuel according to the invention for compression-ignition engines contains at least 80% by weight mono oxymethylene dimethylether, 1 to 20% by weight, preferably 5 to 20% by weight, particularly preferably 5 to 19.7% by weight, of at least one oxygenate of the n-polyoxaalkane type, selected from the group consisting of polyoxymethylene dimethylether, polyethylene glycol dimethylether and/or polyethylene glycol monomethylether formals, and 0.01 to 0.3% by weight di-tert-butyl peroxide.

In a particularly preferred embodiment, up to about 20% by weight, preferably up to 11.5% by weight and particularly preferably up to about 10% by weight, of the monooxymethylene dimethylether can be replaced by dimethylether. This leads to the increase in the vapour pressure to 60 kPa (summer fuel) or 90 kPa (production of a "grease vapour bell") and to the cost reduction. Dimethylether is used here as a replacement fuel for monooxymethylene dimethylether. Dimethyl ether at 20° C. has a vapour pressure of 504 kPa and dissolves well in mono oxymethylene dimethylether. By using dimethylether it is possible to adapt the vapour pressure of the fuel according to the invention for compression-ignition engines to the European standard EN 228 (standard for petrols DIN EN 228 2207 edition) and the cetane number and the filterability to the standard EN 590. The viscosity of the fuel according to the invention for compression-ignition engines approximates the requirements of the standard EN 590 as far as possible.

The quantities contained of the components contained mono oxymethylene dimethylether, oxygenates of the n-polyoxaalkane type, optionally dimethylether and di-tert-butyl peroxide preferably produce proportions of 100% with respect to their % by weight.

The fuel according to the invention for compression-ignition engines has an increased viscosity compared to monooxymethylene dimethylether, the filterability in the cold (CFPP) is retained, the density is increased and the cetane number is brought to a value of ≥48.6, preferably ≥51.

As already mentioned above, the fuel according to the invention for compression-ignition engines in a preferred embodiment does not contain any hydrocarbons, i.e. no diesel fuel proportions based on hydrocarbon.

Furthermore, the fuel according to the invention for compression-ignition engines has the following advantages:

The fuel according to the invention for compression-ignition engines allows the indirect use of methanol as a fuel for engines. Allowing the dispensing of methanol as a fuel at public petrol stations in the European Union and the USA appears to be ruled out in future because of its pronounced toxic properties. On the other hand, methanol can be converted on an industrial scale into mono oxymethylene dimethylether. Thus, the fuel according to the invention for compression-ignition engines allows the indirect use of methanol as a fuel for compression-ignition engines, as methanol is only suitable to operate spark ignition engines.

The fuel according to the invention for compression-ignition engines thus allows the indirect use of methanol and dimethylether as a liquid fuel for diesel engines. Dimethylether is an excellent diesel fuel, which combusts in a soot-free manner like monooxymethylene dimethylether. The main drawback of dimethylether is its low boiling point of −25° C. It therefore has to be handled as a liquid gas and therefore has the drawback that the infrastructure available for liquid fuels cannot be used.

In contrast to methanol, monooxymethylene dimethylether is largely non-toxic. It is also used in cosmetics and pharmaceutics and has the water hazard class 1.

The starting material methanol can be produced directly by the hydrogenation of carbon dioxide. Thus, the possibility exists of recycling carbon dioxide from power stations, cement and steel works and therefore realising a carbon dioxide saving of up to 50% in theory.

The combustion of the fuel according to the invention for compression-ignition engines in lean-running compression-ignition engines, analogously to the combustion of the gaseous dimethylether, also takes place in a soot-free and particle-free manner at high AGR rates. Thus very low NO emissions and particle number emissions can be achieved with measures inside the engine. The exhaust gas post-treatment does not require a particle filter, but only an oxidation catalyst, which prevents the emission of non-combusted and partly combusted fuel according to the invention for compression-ignition engines. The advantages are the reduction in the fuel value-related fuel consumption owing to low exhaust gas back pressure of the exhaust gas system and significant reduction in the costs, the space requirement and the weight of the exhaust gas post-treatment system.

The fuel according to the invention for compression-ignition engines can be produced without particular additional cleaning in a manner substantially free of sulphur compounds. Thus, the use of economical non-high-grade metal catalysts for the post-oxidation of non-combusted oxygenates and carbon monoxide is made possible.

The fuel according to the invention for compression-ignition engines can be used in engines which are lubricated using the chemically related engine oils based on polyalkylene glycol. Thus the usual introduction of small fuel quantities into the engine oil and relatively small engine oil proportions in the fuel remains without negative effects on account of the chemical relationship of the two materials.

The invention will be further illustrated below with the aid of examples. The examples should not however, be in any way limiting or restrictive to the present invention.

Embodiment 1

Monooxymethylene dimethylether is mixed with 20, 10, 7.5 or 5% by weight polyethylene glycol DME 500 (Clariant). The cetane number of the mixtures increases from 40 (monooxymethylene dimethylether) to 75, 55, 51 or 46.5. The viscosity of the mixtures increases from 0.45 to 0.72, 0.53, 0.50 or 0.45 $mm^2/s$. The CFPP drops from <−80° C. to −17° C., −25° C., <−30° C. or <−30° C.

Embodiment 2

5 or 3% by weight polyethylene glycol DME 1000 (Clariant) is dissolved in mono oxymethylene dimethylether.

The mixture has a CN of 53 or 50 and a viscosity of 0.49 or 0.44 $mm^2/s$. The CFPP increases to −3° C. or −10° C.

Embodiment 3

5% by weight polyethylene glycol DME 1000 (Clariant) is dissolved in mono oxymethylene dimethylether. By adding 0.05% by weight or 0.1% by weight DTBP to the mixture, the CN increases to 54.4 or 55.2.

Embodiment 4

3% by weight polyethylene glycol DME 1000 (Clariant) is dissolved in mono oxymethylene dimethylether. By adding 0.05% by weight DTBP to the mixture, the CN increases to 52.

Embodiment 5

Mono oxymethylene dimethylether is mixed with 10% by weight polyethylene glycol DME 500 and 10% by weight tetraoxymethylene dimethylether. The CN increases to 65. The kinematic viscosity increases to 0.59 $mm^2/s$. The increase in the lubricity (lowering of the HFRR wear value to 240 μm) is noteworthy. The CFPP is −28° C.

Embodiment 6

Monooxymethylene dimethylether is mixed with 10% by weight polyethylene glycol DME 500 and 5% by weight tetraoxymethylene dimethylether. The CN increases to 55.

Embodiment 7

5% by weight OME6-10 (OME 6-10=polyoxymethylene dimethylether) is dissolved in monooxymethylene dimethylether (mean MG 290). The CN increases to 55 and the viscosity to 0.7 $mm^2/s$.

Embodiment 8

The fuels described in examples 1 to 7 for compression-ignition engines can absorb up to 11.5% by weight dimethylether by forcing on gaseous dimethylether. The dissolved quantity of monooxymethylene dimethylether depends on the respective vapour pressure requirements of the seasons. The properties of the fuels contained are comparable with those of examples 1 to 7.

Comparative Example 1

Pure monooxymethylene dimethylether (Ineos, Mainz 99.7%) has a CN of 40, a viscosity of 0.45 $mm^2/s$ (20° C.), a surface tension of 21.2 mN/m, a vapour pressure at 20° C. of 42.6 kP and a CFPP of below −60° C.

Comparative Example 2

5% by weight polyethylene glycol monomethylether 350 (Clariant) is dissolved in monooxymethylene dimethylether and 0.1% by weight DTPB is added. The cetane number increases to 51. The solution is frozen at −18° C. Flakes form during thawing, which only completely dissolve at 9.2° C.

Comparative Example 3

3% by weight polyethylene glycol monomethylether 1000 (Clariant) is dissolved in monooxymethylene dimethylether and 0.1% by weight DTPB is added. The cetane number increases to 52. The solution is frozen at −18° C. Flakes form during thawing, which only completely dissolve at 4° C.

The measurement of the cetane number was determined using the measuring apparatus "AFIDA" from the company ASG Analytik Service Gesellschaft, Trentiner Ring 30, 86356 Neusäss:

The functioning principle of AFIDA (Advanced Fuel Injection Delay Analyser) is as follows:

A high pressure pump fills a high pressure store (rail) via a high pressure line with the fuel to be tested. The downstream piezo injection valve (Bosch piezo injector) injects a defined fuel quantity into the preheated combustion chamber loaded with pressurised air.

The finely atomised fuel ignites and the combustion gases produced lead to a pressure increase in the combustion chamber. The time pressure course is recorded at high resolution and the ignition delay and the cetane number are calculated. AFIDA can be coupled to appliances to determine the exhaust gas composition.

The composition of the combustion air can be changed in a targeted manner with the aid of a gas mixer (adjustment of a lambda value). The appliance is calibrated as in the CFR or BASF cetane number motor with primary standards.

A diagram of the test course is shown in FIG. 1.

The work took place under the following test conditions:

| | |
|---|---|
| Combustion chamber temperature | 650° C. |
| Combustion chamber pressure | 10 bar |
| Injection pressure | 1000 bar |
| Injection quantity | 50 mg |
| Fuel thermostatic control | 25° C. |

The sample feed took place fully automatically by means of an autosampler (holding capacity: 36 samples, each 40 ml). The fuel injection takes place by means of a high pressure pump and a standard Bosch piezo injector. This corresponds to the current prior art and is currently installed, for example, in the Audi A6. Once the measurement has taken place, the entire fuel system is automatically flushed to rule out a mixing of samples. The actual combustion takes place in a high pressure cylinder with an approximately 0.6 l combustion volume.

The kinematic viscosity is given in $mm^2/s$ at 20° C. and was determined to DIN ISO 3104.

The CFFP (Cold Filter Plugging Point), i.e. the temperature at which a fuel no longer flows through the test filter under defined conditions, took place to DIN EN 116.

The determination of the diameter of a wear indentation (in μm) as a measure of the lubricity (HFRR (High Frequency Reciprocating Rig)) took place at 25° C. in accordance with DIN EN ISO 12156-1. The greater the diameter, the lower the lubricity of the fuel. The limit value is ≤460 μm to DIN EN 590.

The invention claimed is:

1. A fuel for compression-ignition engines, containing, at least 80% by weight mono oxymethylene dimethylether; and at least one oxygenate of the n-polyoxaalkane type, which is selected from the group consisting of polyoxymethylene dialkylethers of the formula $RO(—CH_2O—)_nR$, wherein n=4 to 10 and R=an alkyl group, polyethylene glycol dialkylethers and/or polyethylene glycol monoalkylether formals, wherein the fuel has a cetane number of ≥48.6.

2. A fuel according to claim 1, wherein the fuel has a cetane number of 51.

3. A fuel according to claim 1, wherein the fuel contains up to 20% by weight of at least one oxygenate of the n-polyoxaalkane type, which is selected from the group consisting of polyoxymethylene dialkyl ethers of the formula $RO(—CH_2O—)_nR$ wherein n=4 to 10 and R=an alkyl group, polyethylene glycol dialkylethers and/or polyethylene glycol monoalkylether formals.

4. A fuel according to claim 1, wherein the polyoxymethylene dialkylethers are polyoxymethylene dimethylethers, the polyethylene glycol dialkylethers are polyethylene glycol dimethylethers and the polyethylene glycol monoalkyletherformals are polyethylene glycol monomethyl ether formals.

5. A fuel according to claim 4, wherein the polyoxymethylene dimethylether has a molecular weight MG of 100 to 400 daltons.

6. A fuel according to claim 4, wherein the polyethylene glycol dimethylether has a molecular weight MG of 400 to 1000 daltons.

7. A fuel according to claim 4, wherein the polyethylene glycol monomethylether formal has a molecular weight MG of 400 to 1000 daltons.

8. A fuel according to claim 1, wherein the fuel contains di-tert-butyl peroxide.

9. A fuel according to claim 8, wherein the fuel contains up to 0.3% by weight, di-tert-butyl peroxide.

10. A fuel according to claim 8, wherein the fuel contains up to 0.1% by weight, di-tert-butyl peroxide.

11. A fuel according to claim 1, wherein up to 20% by weight of the monooxymethylene dimethylether is replaced by dimethyl ether.

12. A fuel according to claim 1, wherein the fuel does not contain any hydrocarbons.

13. A fuel according to claim 1, wherein the fuel contains up to 5% by weight of at least one oxygenate of the n-polyoxaalkane type, which is selected from the group consisting of polyoxymethylene dialkyl ethers of the formula $RO(—CH_2O—)_nR$ wherein n=4 to 10 and R=an alkyl group, polyethylene glycol dialkylethers and/or polyethylene glycol monoalkylether formals.

14. A fuel according to claim 1, wherein the fuel contains up to 3% by weight of at least one oxygenate of the n-polyoxaalkane type, which is selected from the group consisting of polyoxymethylene dialkyl ethers of the formula $RO(—CH_2O—)_nR$ wherein n=4 to 10 and R=an alkyl group, polyethylene glycol dialkylethers and/or polyethylene glycol monoalkylether formals.

15. A fuel for compression-ignition engines containing:

at least 80% by weight mono oxymethylene dimethylether, 1 to 20% by weight of at least one oxygenate of the n-polyoxaalkane type, selected from the group consisting of polyoxymethylene dimethyl ether, polyethylene glycol dimethyl ether and/or polyethylene glycol monomethylether formals, and 0.01 to 0.3% by weight di-tert-butyl peroxide, wherein the fuel has a cetane number of ≥48.6.

* * * * *